United States Patent [19]

Kolm

[11] 4,087,152

[45] May 2, 1978

[54] CONNECTOR ARRANGEMENT

[76] Inventor: Georg Kolm, Salzachstr. 16, 8260 Muhldorf, Germany

[21] Appl. No.: 752,309

[22] Filed: Dec. 20, 1976

[30] Foreign Application Priority Data

Dec. 22, 1975 Germany ..... 2558003

[51] Int. Cl.[2] ..... H01R 13/06

[52] U.S. Cl. ..... 339/252 R; 339/256 R

[58] Field of Search ..... 339/252, 253, 255 RT, 339/256

[56] References Cited

U.S. PATENT DOCUMENTS 3,019,410 1/1962 Logan et al. ..... 339/256 R

FOREIGN PATENT DOCUMENTS 1,452,418 8/1966 France ..... 339/252 R
669,220 12/1938 Germany ..... 339/252 P
310,722 5/1969 Netherlands ..... 339/252 R
340,878 10/1959 Switzerland ..... 339/252 P

*Primary Examiner*—Joseph H. McGlynn
*Attorney, Agent, or Firm*—Michael J. Striker

[57] ABSTRACT

A male or female plug component comprises a discrete tubular member, a resilient contact wire mat rolled up to have a generally cylindrical shape and a further member constituting at least part of the remainder of the plug component. The rolled-up wire mat has an inner part which extends through the interior of the tubular member. The end of the inner part of the rolled-up wire mat projects from within the interior of the tubular member past one end of the tubular member. At the other axial end of the tubular member, the rolled-up wire mat is bent around so as to have an outer part which surrounds the tubular member and extends longitudinally of the latter. The projecting end of the inner part of the wire mat is clamped to the further member.

6 Claims, 4 Drawing Figures

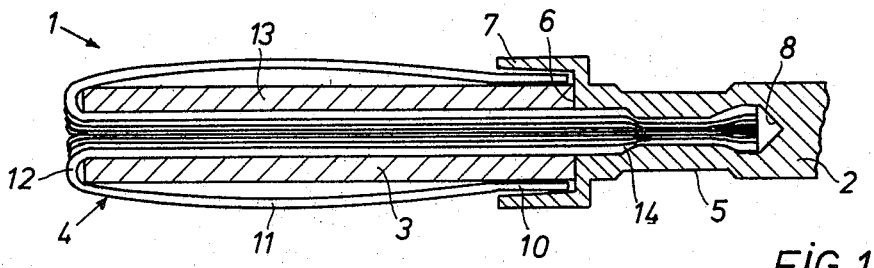
FIG. 1
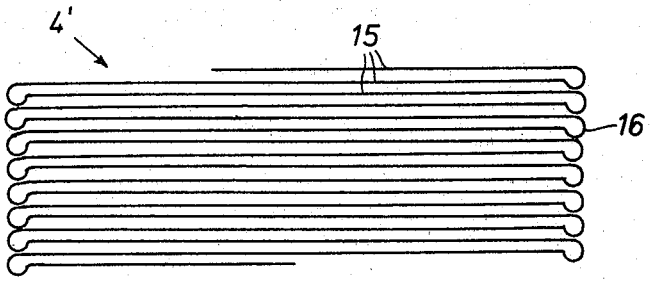
FIG. 2
FIG. 3
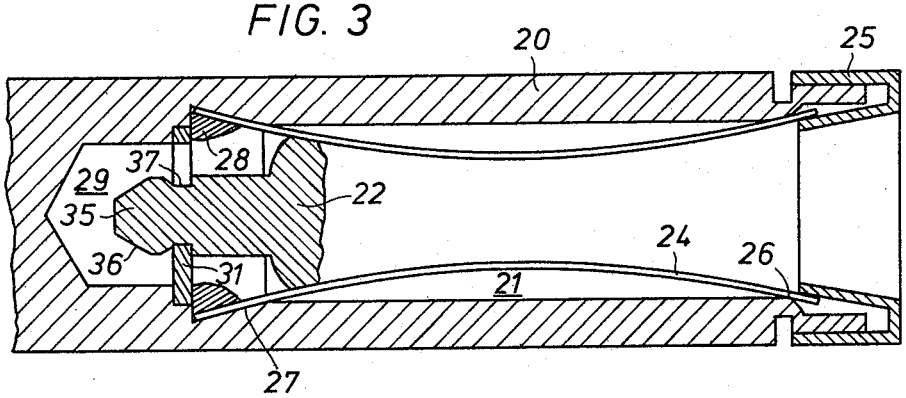
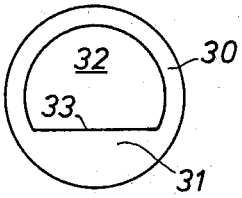
FIG. 4

CONNECTOR ARRANGEMENT

BACKGROUND OF THE INVENTION

The invention relates to electrical connectors of the type made up of two plug components having the form of a jack and a plug insertable into the jack. One of the two plug components is provided with circumferentially distributed resilient contact wires which extend longitudinally of the plug component but bulge in radial direction into electrical contact with the other, cooperating one of the plug components. The contact wires are actually sections of a long wire. These wire sections at the ends thereof continue into curved wire sections, with the wire as a whole following a meandering path to form a resilient wire mat. The wire mat is rolled up to form a cylinder, and fixed in place on the associated one of the plug components by clamping.

A connector utilizing a resilient wire mat is disclosed in my Federal Republic of German patent DT-PS No. 1,263,893. The patent teaches a one-layer rolled-up resilient contact wire mat. The rolled-up wire mat extends axially substantially without bends. At its two axial ends, in the region of the curved wire sections, the wire mat is fixed in place on the associated plug component by respective clamping rings and compressed in axial direction, in order to create the radial inward or outward bulge necessary to establish electrical contact with the other one of the cooperating plug components.

The production of this known connector is effected in the following way. The resilient contact wire mat is originally flat or planar, and the curved end sections connecting together adjoining, parallel straight sections of the contact wire lie in the general plane of the mat. When the wire mat is then rolled-up to form a cylinder, there is imparted to such curved end sections of the contact wire an additional curve, relative to the axis of the cylinder, so that the curve in these end sections is no longer a planar curve, but a three-dimensional curve. This is done to assure that the rolled-up mat will retain its cylindrical shape and not tend to return to its original flat shape. This technique is resorted to with the idea of facilitating assembly, and also is intended to prevent improper disposition of the wire mat in the finished article or improper positioning of its individual sections relative to one another.

The known construction, although advantageous in many respects, is disadvantageous in others. The three-dimensional curvature permanently imparted to the connecting sections at the ends of the parallel major sections of the wire requires an additional working step. Additionally, each end of the rolled-up wire mat must be clamped or fixed in place by means of clamping rings, which is likewise costly. Furthermore, the known construction tends to be expensive because the one of the plug components provided with the wire mat must be a component which extends over the full axial length of the wire mat and which, additionally, must have a multiple-diameter peripheral surface, which must be formed using a lathe, or the like.

Finally, experience has also shown that production errors tend to result with the known construction. In the rolled-up wire mat, the generally straight wire sections do not extend parallel to one another; instead, two adjoining straight sections of the wire, spaced apart from each other at one end due to the presence of the curved connecting section, will at their other ends touch each other. This inclined orientation of the generally straight sections of the wire can lead to improper twisting of the wire sections or to pushing of wire sections one over the other.

I have considered the possibility of making a connector utilizing discrete resilient contact wires arranged to bulge radially outward, with these discrete wires being clamped in place only at the inner end of the plug, by means of a copper sleeve pushed over them and squashed in. The outer ends of the contact wires would then be bent inwardly around and hooked into an annular groove in an axial end face of the plug. This would involve only a single clamping operation for fixing the contact wires in place. However, the assembly of such a construction would require a complicated apparatus for properly orienting the individual wires, including an assembling ring having a grooved peripheral surface. Even with this possibility, it would still be the case that the one-piece plug component carrying the wire mat would have to be lathed over the whole length of the plug in order to have the requisite profile for holding the wire mat.

SUMMARY OF THE INVENTION

It is a general object of the invention to provide an improved connector of the type in question, entirely reliable in use and less costly to produce and assemble.

This object, and others which will become clear from the detailed description below, can be met, according to one advantageous concept of the invention, by supporting the resilient contact wires on a discrete tubular member which extends coaxial with the rolled-up wire mat over the contact region of the latter. The wire mat, which is considerably longer than heretofore, is bent around the outer axial end of the discrete tubular member and bent back so as to include an outer part which encircles the outer periphery of the tubular member and an inner part encircled by the inner periphery of the tubular member. The inner part of the rolled-up wire mat projects out beyond the inner axial end of the tubular member, and this projecting section of the wire mat is clamped into place on a further constituent member of the plug component.

This construction makes unnecessary the imparting of a permanent three-dimensional curve to the curved end sections joining the neighboring straight sections of the meandering contact wire, because the wire mat, even without three-dimensionally curved wire end sections can without any difficulty be rolled up so tight as to ensure that one end of the wire mat can be pushed through the tubular member. After the rolled-up wire mat is thusly pushed through the tubular member, the mat will tend to expand, due to the inherent restoring force within the wires of the mat, to such an extent that all the straight wire sections of the mat will press against the inner peripheral surface of the tubular member. As a result, the mat will be held in its correct position in a very simple way, and the portion of the wire mat projecting past the axial end of the tubular member can then be formed or bent back against the outer peripheral surface of the tubular member, in the manner already mentioned.

The tubular member accordingly constitutes an aid to assembly, but one which forms part of the finished plug section, and is not to be removed. The remainder of the plug component can be short in length, in correspondence to the relative length of the tubular member, and this short section requires relatively little lathe work, or the like. The tubular member, extending over the contact region of the wire mat, is uniform and even along both its inner and outer peripheries and therefore requires no particular additional production or assembly cost. This construction has the advantage that the clamping of the wire mat into place on the short or residual section of the plug component simultaneously serves to connect the latter with the tubular member. By appropriately dimensioning the wire mat, the tubular member, abutting with its axial end face against a support surface, can be made capable of limited tilting motion, resisted by the inherent springiness of the wire mat. This is advantageous for the sake of flexibility and to compensate for tolerance deviations of the parts to be assembled or connected. Additionally, the inventive construction makes it unnecessary to fix in place the free end of the wire mat by bending it over and hooking it into place.

According to an advantageous concept of the invention, the inner axial end of the tubular member abuts against a support surface provided on the remainder of the plug component. In that event, no special fitting surfaces need be provided on the tubular member or on the remainder of the plug component, and the tubular member can perform resilient tilting movements, as already mentioned. A mechanically stable construction in which the wire mat is fixedly secured at both ends can be achieved at low cost by fixing the wire mat in place on the remainder of the plug component with the tubular member being fixedly connected thereto in such a manner as to press axially against the remainder of the plug component.

According to another advantageous concept of the invention, the connecting sections intermediate the adjoining straight wire sections of the wire mat are curved to describe an arc of a circle greater than 180°, with each straight wire section at one of its ends merging tangentially into an associated one of the curved connecting sections and at its other end emerging from the other associated connecting section bent at an angle outwardly relative thereto. Advantageously, the curved connecting sections each describe an arc of about 270°.

This structural feature counteracts any tendency for the straight wire sections of the wire mat to assume tilted positions. When the wire mat is rolled up into a cylinder, the curved connecting sections at the two ends of the mat will be free to abut against one another without producing a tendency for the ends of the associated wire sections at the other end of the mat to then touch each other; this is because the curved connecting sections at such other end of the mat will themselves tend to space apart such other ends of the straight wire sections. With the $\frac{3}{4}$-arc expedient in question, each curved connecting section has a position-determining effect upon three successive straight wire sections of the mat, with the outer two of such three sections being kept apart a distance equal to the arc diameter, whereas the middle of the three will be kept spaced apart from the other two by a distance corresponding to the radius of such arc.

According to a further inventive concept, one of the two cooperating plug components is provided with an engaging nose, and the other with a peripheral groove into which such nose can enter. This makes for an auxiliary securing effect tending to prevent unintentional release of the connector. When this is done, use is made of the inherent spring force of the mat wire sections. The resilience of the mat wire sections permits tilting of the plug relative to the jack in either tilting direction, and at the same time establishes a bidirectional centering effect, contributing to the cooperation between the engaging nose and the peripheral groove just mentioned.

According to another advantageous concept, the engaging nose is provided a jack in turn provided with the wire mat at the inner end of the recess which receives the plug. The plug, then, is provided with the aforementioned peripheral groove on its outer end.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is an axial section through a plug embodying the invention;

FIG. 2 shows the path followed by the constituent wire of the resilient contact wire mat used in FIG. 1, before the mat is rolled up;

FIG. 3 is an axial section through a jack embodying the invention, with a cooperating plug shown inserted into the jack; and FIG. 4 is an axial view of the component part used in the structure of FIG. 3 for securing the plug properly in place relative to the jack.

DESCRIPTION OF THE PREFERRED EMBODIMENTS

The plug 1 shown in FIG. 1 comprises a plug section 2, a tube 3 arranged coaxial with the plug section 2, and a resilient wire mat 4. The plug section 2 is relatively short and is provided with a squashed section 5 serving to fix the resilient wire mat 4 in place on the plug section 2. Plug section 2 has an abutment surface 6 against which abuts the axial end face of the tube 3. Additionally, the plug section 2 has a collar 7 which surrounds the inner (right) end of the tube 3. The plug section 2 is furthermore provided with an axial bore 8 which extends rightward starting from the abutment surface 6.

In the finished construction, the resilient wire mat 4 is rolled to form a cylinder. The shape of this cylinder is best grasped by considering the two wire sections thereof which are located in the section plane of FIG. 1. The wire sections extending parallel to these two wire sections are indicated in FIG. 1, but not clearly visible there. The resilient wire mat 4 includes an outer end section 10 located intermediate the tube 3 and the collar 7. The resilient wire mat 4 furthermore includes a radially outwardly bulging contact section 11 on the outer side of the tube 3, a connecting section 12 which is bent about 180° around the outer (left) end face of the tube 3, a straight section 13 which extends through the interior of tube 3, and an inner end section 14 which projects past the tube 3 into the bore 8 of the plug section 2. This inner end section 14 is fixed to the plug section 2 at the quashed part 5 thereof by squashing or deformation of the plug section 2. This squashing also serves to connect the tube 3 with the plug section 2. The outer end section 10 of the resilient wire mat 4 is capable of a limited amount of shifting movement within the collar 7. Accordingly, when the plug 1 is inserted into a cooperating jack, the contact section 11 of the resilient wire mat 4 can be radially inwardly displaced in a resilient manner.

FIG. 2 depicts, schematically and on a different scale, the path of the resilient wire making up the wire mat 4, before the wire mat 4 is rolled up into a cylindrical shape, bent around the outer (left) axial end of the tube 3, and squashed at its inner (right) end. The planar mat 4′ of FIG. 2 is composed of a series of straight wire sections 15 extending parallel to one another, as well as curved connecting sections 16, each of which connects together two neighboring ones of the straight sections 15. Successive ones of the connecting sections 16 alternate from one end of the mat 4 to the other, so that the resilient wire of the mat follows a generally meandering path. As illustrated, each connecting section 16 extends along 270° of the arc of a circle, with one associated straight section 15 merging tangentially into the connecting section 16, and the other associated straight section 15 emerging from the connecting section 16 bent at a right angle relative thereto. This design has the advantageous result that, when the connecting sections 16 are fixed in place and abutting against one another, the straight wire sections 15 are supported at each end of the mat 4 in such a way as to extend parallel to one another. In the interests of simpler bending operations, it may be desired that the transitional region between the curved connection section 16 and the adjoining bent off straight section 15 be more or less rounded off, so as to avoid the formation of a sharp-edged right-angle bend. In any event, what is of importance is that the straight wire sections 15 extend parallel to one another with substantially uniform spacing.

To make the plug 1 shown in FIG. 1, the initially flat resilient wire mat 4′, shown as having a length about two and one-half times its width, is rolled up in direction transverse to its elongation to a diameter less than that of the tube 3, and then pushed through the tube 3 until there emerges from one end (the inner end) of the tube 3 a length of wire mat corresponding to the inner end section 14 of FIG. 1. Then, the part of the rolled-up wire mat 4′ projecting a considerable distance from the other (the outer) end of the tube 3 is bent around the outer (left) axial end of the tube 3 and bent back so as to surround the outer side of the tube 3. The mat 4′ is then deformed to the shape shown in FIG. 1, i.e., so as to have a contact section 11 which bulges radially outward as well as an axially extending outer end section 10. Thereupon, the tube 3, with the contact wire mat 4 thereon, is axially pressed against the abutment surface 6 of the plug section 2, with the outer end section 10 of the wire mat 4 becoming covered by the collar 7 and the inner end section 14 of the mat 4 penetrating into the bore 8 of the plug section 2. The metal in the compressed section 5 is then radially inwardly deformed, for example by squashing, as the last step of assembly.

FIG. 3 depicts a jack 20 having a bore or recess 21 for receiving a partially illustrated plug 22. The plug 22 of FIG. 3 is of different design than the plug 1 of FIG. 1 and is not provided with a wire mat; instead, a resilient wire mat 24 is provided on the jack 20. This resilient wire mat 24, likewise, is formed from an initially planar mat 4′ such as shown in FIG. 2. After it is rolled up into a cylinder, it is inserted into the jack 20. As with the tube 3 in the embodiment of FIG. 1, the jack 20 of FIG. 3 with its inner circumferential surface prevents expansion of the rolled-up mat 4′. To establish the illustrated radially inward bulge in the wire mat 24, the mat is pressed conically outward at both its ends, e.g., against conical portions of the inner surface of the jack 20. The dimensions of the illustrated structure can be so chosen that the straight wire sections 15 are uniformly spaced at the axial ends of the rolled-up mat 24, but converge at the middle thereof to form a ring of abutting wire sections.

The forming and fixing in place of the resilient wire mat 24 is accomplished with the aid of a deformable copper sleeve 25 which cooperates with an annular bending line 26 on the inner peripheral surface of the jack 20. The radially inner, annular wall of sleeve 24 initially is located somewhat radially inward of the right end of the rolled-up wire mat 24. The fixing in place of the right end of the wire mat can be effected by deforming the inner annular wall of sleeve 24 radially outwardly all around its circumference, and by deforming the outer annular wall of sleeve 25 radially inwardly all around its circumference, so that the sleeve 25 will be fixed in place on the right end of jack 20 and secure the right end of the rolled-up wire mat 24. The inner (left) end of the resilient wire mat 24 is supported by means of a conical support surface 27 on the inner peripheral surface of the jack 20 and is secured in place with limited freedom to move longitudinally by means of an internal annular member 28. After insertion of internal annular member 28, the latter can be radially outwardly deformed, in order to properly secure the inner (left) end of the mat 24 in place.

FIG. 3 depicts part of a plug 22 which has been inserted into a position of electrical contact within the jack 20. The plug head 35 projects inward (leftward) through an opening 32 in a securing ring 30 (shown in front view in FIG. 4) located in the bore 29 of the jack 20. The ring 30 is provided with an engaging nose 31 which engages peripheral groove 37 in the end of the plug 2. When the plug 22 is first inserted into the jack 20, the conical surface 36 of the plug head 35 hits the edge 33 of the engaging nose 31 and then slides over and past it, as a result of which the plug 22 will be temporarily skewed. This temporary skewing of the plug 22 is permitted by the yieldability of the wire mat 24. The spring force exerted by the resilient wire mat 24 attempts to restore the skewed plug 22 to a coaxial orientation, and such an orientation is reassumed as soon as the plug has been fully inserted, whereupon the aforementioned engaging nose 31 enters into the peripheral groove 37.

It will be understood that each of the elements described above, or two or more together, may also find a useful application in other types of construction differing from the types described above.

While the invention has been illustrated and described as embodied in a male and female plug component, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an electrical connector of the type comprised of a male plug component and a female plug component, a plug component which comprises, in combination, a discrete tubular member; a resilient contact wire mat rolled up to have a generally cylindrical shape; and at least one further member constituting at least part of the remainder of the plug component, the rolled-up wire mat having an inner part which extends through the interior of the tubular member, the end of the inner part of the rolled-up wire mat projecting from within the interior of the tubular member past one end of the tubular member, the rolled-up wire mat at the other axial end of the tubular member being bent around so as to have an outer part which surrounds the tubular member and extends longitudinally of the latter, the end of the inner part of the wire mat being clamped to the further member.

2. In a connector as defined in claim 1, the tubular member, the wire mat and the further member together forming a male plug component, the outer part of the rolled-up wire mat bulging radially outward, whereby to facilitate electrical contact with a cooperating female plug component.

3. In a connector as defined in claim 1, the tubular member and the further member being arranged coaxial to each other, the further member being provided with a support surface, the tubular member at said one axial end thereof abutting against the support surface.

4. In a connector as defined in claim 1, the wire mat being constituted by a meandering contact wire composed of generally parallel and straight wire sections joined together at their ends by curved connecting wire sections, the generally straight wire sections of the mat extending longitudinally of the tubular member both within the inner part and the outer part of the mat.

5. In a connector as defined in claim 4, each curved connecting wire section describing an arc of more than 180°, each straight wire section of the wire mat merging at its one end tangentially into the associated curved connecting wire section and at its other end emerging from the associated curved connecting wire section at an angle relative thereto.

6. In a connector as defined in claim 5, each curved connecting wire section describing an arc of approximately 270°.

* * * * *